United States Patent [19]

Postma et al.

[11] Patent Number: 4,704,562

[45] Date of Patent: Nov. 3, 1987

[54] ELECTRODELESS METAL VAPOR DISCHARGE LAMP WITH MINIMIZED ELECTRICAL INTERFERENCE

[75] Inventors: Pieter Postma; Patricius W. M. Lepelaars, both of Eindhoven, Netherlands

[73] Assignee: U.S. Philips Corporation, New York, N.Y.

[21] Appl. No.: 642,978

[22] Filed: Aug. 21, 1984

[30] Foreign Application Priority Data

Sep. 1, 1983 [NL] Netherlands ..... 8303044

[51] Int. Cl.[4] ..... H05B 41/16

[52] U.S. Cl. ..... 315/248; 315/39; 315/344; 315/85; 313/493; 313/486; 313/488; 313/485

[58] Field of Search ..... 315/248, 39, 344, 85; 313/493, 485–488

[56] References Cited

U.S. PATENT DOCUMENTS

| | | | |
|---|---|---|---|
| 3,227,923 | 1/1966 | Marrison | 315/248 |
| 3,521,120 | 7/1970 | Anderson | 315/248 |
| 3,987,335 | 10/1976 | Anderson | 315/248 |
| 4,119,889 | 10/1978 | Hollister | 315/248 |
| 4,187,447 | 2/1980 | Stout et al. | 315/85 |
| 4,206,387 | 6/1980 | Kramer et al. | 315/248 |
| 4,240,010 | 12/1980 | Buhrer | 315/85 |
| 4,254,363 | 3/1981 | Walsh | 315/85 |
| 4,262,233 | 4/1981 | Becker et al. | 315/248 |
| 4,422,017 | 12/1983 | Denneman et al. | 315/248 |
| 4,568,859 | 2/1986 | Houkes et al. | 315/248 |

*Primary Examiner*—David K. Moore
*Assistant Examiner*—Michael Razavi
*Attorney, Agent, or Firm*—Emmanuel J. Lobato

[57] ABSTRACT

An electrodeless metal vapor discharge lamp comprising a lamp vessel (1) which is sealed in a vacuum-tight manner and is further filled with a rare gas, which lamp is provided with a core (4) of magnetic material, in which a high-frequency magnetic field can be induced by means of an electric supply unit (7) and a winding (5) arranged to surround the core, an electric field being produced in the lamp vessel (1), the surface area of a cross-section orthogonal to the axis of the winding lying between 20 $mm^2$ and 60 $mm^2$, the lamp vessel (1) containing as rare gas krypton and/or argon at a pressure of at most 100 Pa, and the axial length of the winding lying between 8 and 15 mm.

24 Claims, 2 Drawing Figures

ELECTRODELESS METAL VAPOR DISCHARGE LAMP WITH MINIMIZED ELECTRICAL INTERFERENCE

BACKGROUND OF THE INVENTION

The invention relates to an electrodeless metal vapor discharge lamp comprising a lamp vessel which is sealed in a vacuum-tight manner and is further filled with a rare gas, this lamp being provided with a core of magnetic material in which a high-frequency magnetic field can be induced by means of an electric supply unit and a winding arranged to surround the core, an electric field being produced in the lamp vessel during lamp operation. Such a lamp is known from U.S. Pat. No. 3,521,120.

This U.S. Patent Specification discloses an electrodeless fluorescent low-pressure mercury vapor discharge lamp having such a form that it is suitable to serve as an alternative to an incandescent lamp intended for general illumination purposes, for example for use in a private house. An electrodeless mercury vapor discharge lamp has a favorable efficiency as compared with an incandescent lamp, while with a suitable choice of the luminescent material on the inner wall of the lamp vessel a satisfactory color rendition can be obtained. The lamp is operated at a high-frequency supply voltage, that is to say that the supply voltage has a frequency which is generally higher than 20 kHz.

A problem which arises during operation of the above lamps is that the electromagnetic field produced in the lamp extends outside the lamp vessel in the neighbourhood of the lamp. As a result, especially due to the magnetic component of the field, annoying and disturbing signals occur, for example, in electrical apparatus, such as radio receivers and the like, arranged in the proximity of the lamp. For the intensity of the electromagnetic field outside the lamp international standards have to be observed, which can easily be exceeded without the use of special measures. Special measures for suppressing the said undesired phenomena which are taken in the lamp are, for example, the application of a thin transparent conductive layer to the inner wall of the lamp vessel, as described, for example, in U.S. Pat. No. 4,171,503, or the provision of a metal anti-interference ring around the lamp vessel (see U.S. Pat. No. 4,187,447). However, it has been found that despite these measures the disturbing field is insufficiently suppressed and also that the heat developed in the core of magnetic material is liable to rise during operation to such a value that the efficiency of the lamp is adversely affected.

SUMMARY OF THE INVENTION

The invention has for its object to provide an electrodeless discharge lamp having dimensions which are comparable with those of the aforementioned incandescent lamp, which lamp has a high efficiency, while the intensity of interference signals in apparatus arranged in the proximity of the lamp, which signals are due to electromagnetic fields originating from the lamp and emanating from the lamp vessel, is reduced to an acceptably low level.

According to the invention, the electrodeless metal vapor discharge lamp of the kind mentioned in the opening paragraph is characterized by the core formed so that the surface area of a cross-section orthogonal to the axis of the winding lies between 20 $mm^2$ and 60 $mm^2$, the rare gas present in the lamp vessel contains kryton and/or argon at a pressure of at most 100 Pa and the axial length of the winding lies between 8 and 15 mm.

It has been found that in the lamp according to the invention a surprisingly low voltage per turn and hence a very low value of the electromagnetic interference field is obtained with the comparatively small surface area of the cross-section of the magnetic core (with a cylindrical core this corresponds to a comparatively small diameter) in conjunction with the axial length of the winding (i.e. the distance between its outermost turns) and the said rare gas. It has further been found that such a lamp has a very high efficiency. Experiments have shown that the intensity of the electromagnetic interference field is proportional to the voltage per turn and increases when the length of the winding is located outside the preferred range. At the aforementioned values of this length and of the surface area of the cross-section, it has been found that the efficiency of the lamp is at an optimum and the disturbing field is comparatively weak.

With a surface area of the core cross-section larger than the said limit value, the voltage per turn increases during operation of the lamp to such a value that the intensity of the field outside the lamp vessel exceeds the permissible standard value (see, for example VDE 0871). On the contrary, with too small a surface area, during operation of the lamp thermal problems arise in the core and in the lamp vessel, as a result of which additional measures for dissipating heat developed in the core are necessary. Such a heat development leads to a reduction of the efficiency of the lamp and to an unfavorable influence on the magnetic properties of the core material.

A reduction of efficiency is also obtained if a comparatively light rare gas, such as helium or neon, is present in the lamp vessel. It has been found that with these gases the voltage per turn is comparatively high. Due to the presence of krypton and/or argon in the lamp vessel at the said low pressure, these phenomena are substantially completely avoided. It has been found that at a rare gas pressure of more than 100 Pa the efficiency of the lamp decreases considerably. Favorable results were obtained with lamps having a power consumption of at most 25 W, with the lamp vessel containing the rare gas krypton at a pressure of at most 100 Pa. It has further surprisingly been found that the ignition properties of lamps according to the invention are very favorable.

In a lamp according to the invention, the axial length of the winding lies between 8 and 15 mm. With a larger length it has been found that the intensity of the interference field increases considerably; with lengths of less than 8 mm, beside a stronger disturbing field a reduction of efficiency is measured. Very favorable results were obtained with a winding having a length of 11 to 13 mm comprising preferably 10 to 15 turns.

Preferably, the magnetic core is in the form of a cylindrical rod whose cross-section orthogonal to the axis of the winding has a surface area of 45 to 55 $mm^2$ and which is located in a tubular re-entrant part in the wall of the lamp vessel. A lamp provided with a core having such a form can be manufactured in a comparatively simple manner. In addition, means for dissipating heat developed notably in lamps operated at a comparatively high power in the core during operation can be arranged in a comparatively simple manner (see Dutch Patent Application No. 8104223 laid open to public inspection).

BRIEF DESCRIPTION OF THE DRAWING

The invention will be described more fully with reference to the drawings.

In the drawings

DETAILED DESCRIPTION OF THE INVENTION

Figure 1:
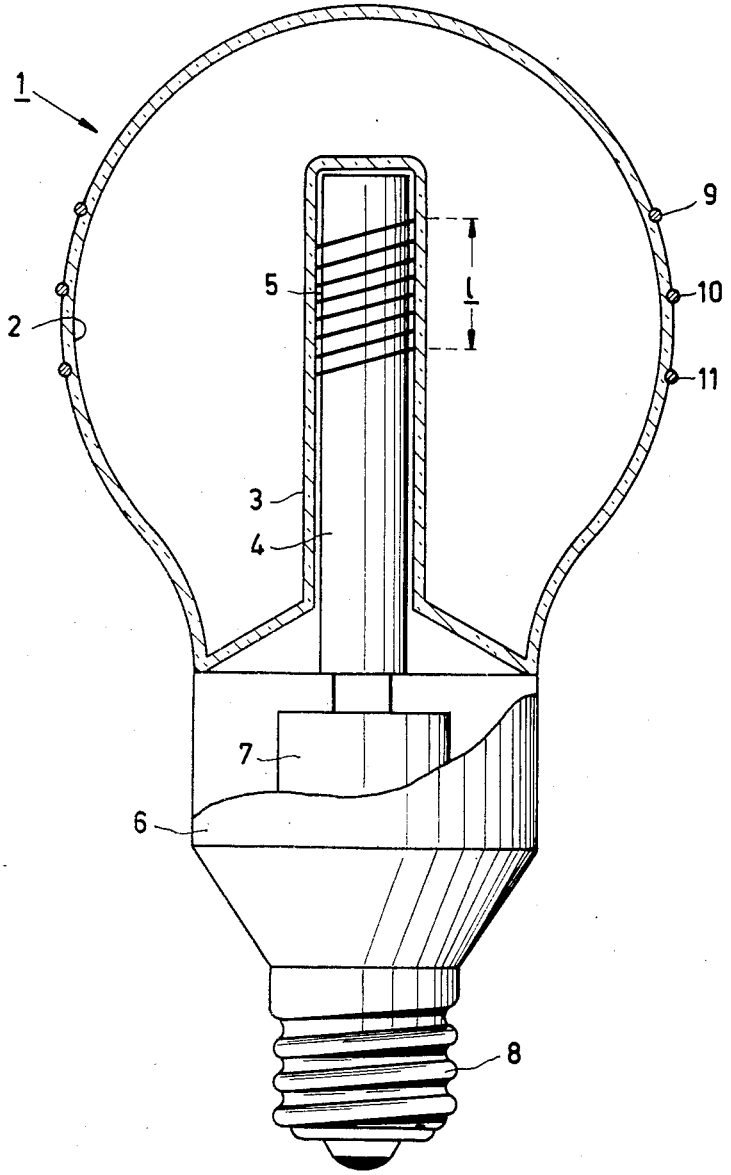
FIG. 1 shows diagrammatically (partly in elevation and partly in sectional view) an embodiment of an electrodeless low-pressure mercury vapour discharge lamp according to the invention.

The lamp shown in FIG. 1 comprises a glass lamp vessel 1 which is sealed in a vacuum-tight manner and is filled with a quantity of mercury and with a quantity of krypton at a pressure of approximately 70 Pa. The inner wall of the lamp vessel is coated with a thin layer 2 of luminescent material, by means of which the ultraviolet radiation produced in the lamp vessel during operation of the lamp is converted into visible light. The wall of the lamp vessel 1 is provided with a tubular re-entrant part 3 in which a rod-shaped core 4 of magnetic material (ferrite) is present. During operation of the lamp, a high-frequency magnetic field is induced in the core 4 by means of a winding 5 which is arranged to surround the core and is connected to an electric supply unit 7 located in a housing 6 of synthetic material. The housing 6 is provided with a sleeve 8 so that the lamp can be screwed into a fitting suitable for an incandescent lamp. The housing is connected to the lamp vessel.

The rod-shaped core 4 is shaped so that the surface area of a cross-section orthogonal to the axis of the winding 5 lies between 20 $mm^2$ and 60 $mm^2$; in the embodiment shown, the surface area is approximately 50 $mm^2$. The axial length l of the winding 5 lies between 8 and 15 mm, preferably between 11 and 13 mm. The number of turns of the winding is important for a favourable electrical coupling between the high-frequency supply and the gas discharge during operation of the lamp. It has been found that with a number of turns of 10 to 15 this coupling is at an optimum with the said length of the winding.

In an alternative embodiment (not shown in the drawings), a copper or aluminium rod is present in the core for dissipating the heat developed in the core in the direction of the lamp base (see Dutch Patent Application No. 8104223 laid open to public inspection. It should be noted that in the cross-section of the core the surface area of the magnetic material must not exceed the aforementioned values. In the embodiment shown in the drawing, three copper wire-shaped anti-interference rings 9, 10 and 11 enclosing the discharge are present around the lamp vessel 1 at the level of the coil 5, which are located in grooves specially provided for this purpose in the outer wall of the lamp vessel.

Figure 2:
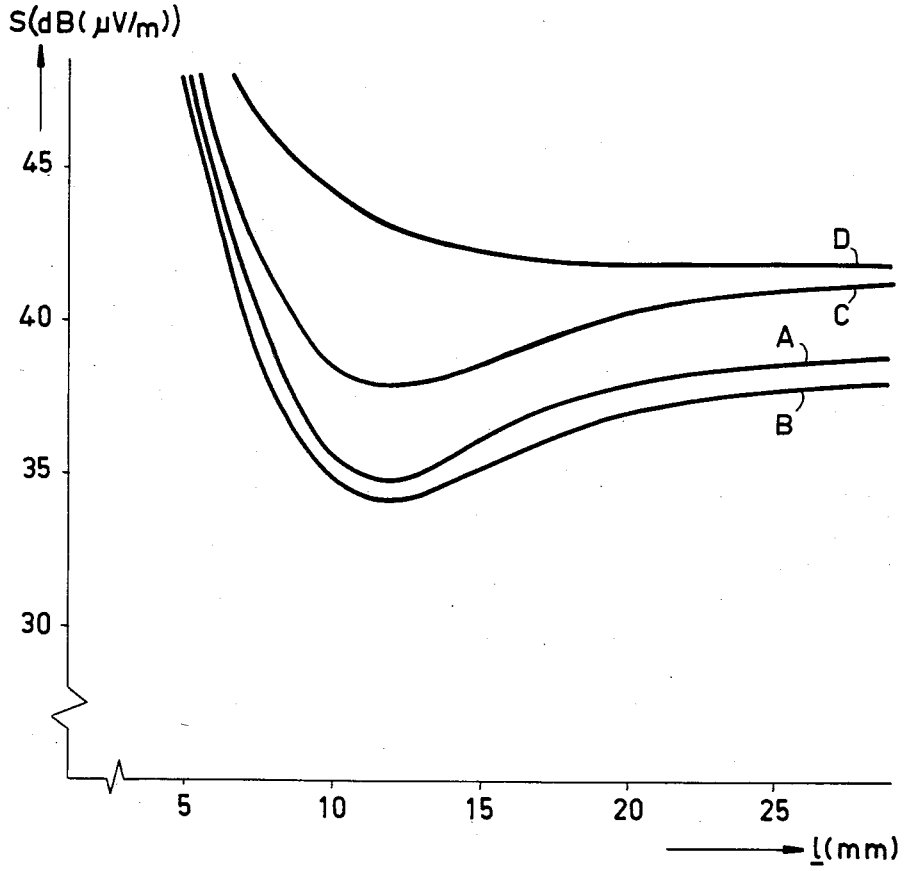
FIG. 2 is a graph in which the intensity of the disturbing electromagnetic field is plotted as a function of the length of the winding at different values of the rare gas pressure, for lamps having a configuration of the kind shown in FIG. 1.

In the graph of FIG. 2, the measured intensity of the magnetic component of the interference electromagnetic field S (dB ($\mu$V/m)) is plotted as a function of the axial length l (mm) of the winding of a lamp of the kind shown in FIG. 1 with a power supply of about 13 W. The intensity of the (interference) field is measured according to international standards by means of an antenna arranged at a distance of about 30 m from the lamp vessel. The measurements were carried out on lamps having different lengths of the winding, different rod core diameters and rare gases. In the graph, curve A indicates the variation of the value of the disturbing field at a pressure of about 70 Pa of krypton and a diameter of the rod-shaped magnet core of 8 mm (surface area cross-section 50 $mm^2$). The curve has a minimum at a length of the winding of 12 mm. Curve B also indicates a variation of the value of the field (Kr, 70 Pa), but with a rod diameter of 6 mm. This curve also shows that the winding length preferably has to lie at about 12 mm in order to fulfil the requirements with respect to disturbance. It has been found that the disturbance level is slightly lower with a diameter of 6 mm than with a diameter of 8 mm. Curve C indicates a situation in which krypton is present in the lamp vessel at a pressure of 60 Pa, but in which the diameter of the rod core is 11.5 mm. In this case a minimum can be recognized, it is true, but it is less strongly pronounced. The interference field if also stronger than in the lamps according to the curves A and B. It further appears that the influence of the length of the winding on the interference level is smaller. Curve D (argon, pressure 200 Pa) does not show a minimum. The measured field values in this case were such that the said interference standards were exceeded by far.

The table below gives the measurement results on a number of lamps (power supply about 13 W) with a rod core having different diameters and a winding having different lengths.

TABLE

| Lamp | Rare gas/ pressure (Pa) | Diameter core (mm) | Length winding (mm) | Disturbance value (dB($\mu$V/m)) |
|---|---|---|---|---|
| 1 | Kr,70 | 6 | 8 | 38 |
| 2 | Kr,70 | 6 | 12 | 34 |
| 3 | Kr,70 | 6 | 16 | 36 |
| 4 | Kr,70 | 8 | 8 | 39 |
| 5 | Kr,70 | 8 | 12 | 35 |
| 6 | Kr,70 | 8 | 16 | 37 |
| 7 | Kr,60 | 11.5 | 8 | 41 |
| 8 | Kr,60 | 11.5 | 12 | 38 |
| 9 | Kr,60 | 11.5 | 16 | 39 |
| 10 | Kr,150 | 8 | 12 | 35 |
| 11 | Ar,150 | 8 | 12 | 41 |
| 12 | Ar,200 | 11.5 | 12 | 43 |

In a practical embodiment of a lamp of the kind described above, the diameter of the glass lamp vessel is about 70 mm and the length is about 90 mm. The lamp vessel contains a small quantity of mercury (about 6 mg) and a quantity of krypton at a pressure of about 70 Pa. The luminescent layer comprises a mixture of two phosphors, i.e. green luminescing terbium-activated cerium-magnesium aluminate and red luminescing yttrium oxide activated by trivalent europium. The magnetic material of the cylindrical core (length 50 mm, diameter 80 mm) consists of a ferrite having a relative permeability of about 150 (Philips 4C6 ferrite). The core is surrounded by a winding having a length l between the uppermost and the lowermost turn (the axial length of the winding) of about 12 mm. The winding comprises twelve turns (wire thickness 250 $\mu$m). The inductance of the coil thus formed is about 6.5 $\mu$H. The supply unit includes a high-frequency oscillator having a frequency of about 2.65 MHz. The wires of the said copper rings (9, 10, 11) arranged to surround the lamp vessel have a thickness of about 1 mm. The distance between the outer wall of the ferrite core and the wall 3 of the re-entrant part is comparatively small (about 0.5 mm), whereby a favorable effect on the efficiency of the lamp has been found to occur. With a power supply to the lamp of 13 W, the luminous flux is about 900 lumen. The efficiency of the lamp is about 70 lm/W. An experiment with this lamp further showed that with a higher power supply (for example 20 W) the intensity of the interference field decreased further, but that a reduction in efficiency also occurred.

What is claimed is:

1. An electrodeless metal vapor discharge lamp comprising a lamp vessel which is sealed in a vacuum-tight manner and is further filled with a rare gas, this lamp being provided with a core of magnetic material, in which a high-frequency magnetic field can be induced by means of an electric supply unit and a winding arranged to surround the core, an electric field being produced in the lamp vessel during lamp operation, characterized in that the core is shaped so that the surface area of a cross-section orthogonal to the axis of the winding lies between 20 $mm^2$ and 60 $mm^2$, the rare gas present in the lamp vessel containing krypton and/or argon at a pressure of at most 100 Pa, the axial length of the winding lying between 8 and 15 mm.

2. An electrodeless metal vapor discharge lamp as claimed in claim 1, characterized in that the core of magnetic material is rod-shaped and its cross-section has a surface area of 45 to 55 $mm^2$, which core is located in a tubular re-entrant part in the wall of the lamp vessel.

3. An electrodeless metal vapor discharge lamp as claimed in claim 1, characterized in that the lamp vessel contains krypton at a pressure of at most 100 Pa, the power supply to the lamp being at most 25 W.

4. An electrodeless metal vapor discharge lamp as claimed in claim 1, characterized in that the length of the winding lies between 11 and 13 mm and the winding comprises 10 to 15 turns.

5. An electrodeless metal vapor discharge lamp as claimed in claim 2, characterized in that the lamp vessel contains krypton at a pressure of at most 100 Pa, the power supply to the lamp being at most 25 W.

6. An electrodeless metal vapor discharge lamp as claimed in claim 2, characterized in that the length of the winding lies between 11 and 13 mm and the winding comprises 10 to 15 turns.

7. An electrodeless metal vapor discharge lamp as claimed in claim 3, characterized in that the length of the winding lies between 11 and 13 mm and the winding comprises 10 to 15 turns.

8. An electrodeless metal vapor discharge lamp as claimed in claim 5, characterized in that the length of the winding lies between 11 and 13 mm and the winding comprises 10 to 15 turns.

9. An electrodeless metal vapor discharge lamp optimized to minimize radiated electrical interference, comprising:

a core of magnetic material having a generally straight portion, wherein said straight portion has a cross-sectional area between about 20 $mm^2$ to about 60 $mm^2$;

a sealed transparent envelope having an inwardly protruding tubular portion dimensioned to receive said core straight portion, and said core straight portion disposed within said envelope tubular position;

a single winding wound on said core straight portion and extending over between about 8 mm to about 15 mm of the length of said core straight portions;

an ionizable fill material within said envelope comprised of a vaporizable metal and a rare gas selected from the group consisting essentially of argon, krypton and a mixture of argon and krypton, and said rare gas having a maximum pressure of about 100 Pa;

a layer of fluorescent material disposed on said envelope and responsive to radiation from the ionized fill material for emitting light; and means for applying a high-frequency electrical signal to said winding to produce an ionizing field within said envelope effective to ionize the fill material within said envelope and thereby excite said fluorescent material to emit light.

10. An electrodeless metal vapor discharge lamp according to claim 9, wherein said means for applying a high frequency electrical signal to said winding includes a high-frequency electrical supply, and said lamp further comprises a base unit with said envelope mounted on said base unit and said high-frequency electrical supply mounted within said base unit.

11. An electrodeless metal vapor discharge lamp according to claim 10, wherein said winding extends over between about 11 mm to about 13 mm of the length of said core straight portion, and said winding comprises 10 to 15 turns.

12. An electrodeless metal vapor discharge lamp according to claim 10, wherein said rare gas contains krypton at a pressure of about 60 Pa to about 100 Pa.

13. An electrodeless metal vapor discharge lamp according to claim 12, wherein said winding extends over between about 11 mm to about 13 mm of the length of said core straight portion, and said winding comprises 10 to 15 turns.

14. An electrodeless metal vapor discharge lamp according to claim 10, wherein said core straight portion has a cross-sectional area between about 45 $mm^2$ to about 55 $mm^2$.

15. An electrodeless metal vapor discharge lamp according to claim 14, wherein said winding extends over between about 11 mm to about 13 mm of the length of said core straight portion, and said winding comprises 10 to 15 turns.

16. An electrodeless metal vapor discharge lamp according to claim 14, wherein said rare gas contains krypton at a pressure of about 60 Pa to about 100 Pa.

17. An electrodeless metal vapor discharge lamp according to claim 16, wherein said winding extends over between about 11 mm to about 13 mm of the length of said core straight portion, and said winding comprises 10 to 15 turns.

18. An electrodeless metal vapor discharge lamp according to claim 9, wherein said core straight portion has a cross-sectional area between about 45 $mm^2$ to about 55 $mm^2$.

19. An electrodeless metal vapor discharge lamp according to claim 18, wherein said winding extends over between about 11 mm to about 13 mm of the length of said core straight portion, and said winding comprises 10 to 15 turns.

20. An electrodeless metal vapor discharge lamp according to claim 18, wherein said rare gas contains krypton at a pressure of about 60 Pa to about 100 Pa.

21. An electrodeless metal vapor discharge lamp according to claim 20, wherein said winding extends over between about 11 mm to about 13 mm of the length of said core straight portion, and said winding comprises 10 to 15 turns.

22. An electrodeless metal vapor discharge lamp according to claim 9, wherein said rare gas contains krypton at a pressure of about 60 Pa to about 100 Pa.

23. An electrodeless metal vapor discharge lamp according to claim 22, wherein said winding extends over between about 11 mm to about 13 mm of the length of said core straight portion, and said winding comprises 10 to 15 turns.

24. An electrodeless metal vapor discharge lamp according to claim 9, wherein said winding extends over between about 11 mm to about 13 mm of the length of said core straight portion, and said winding comprises 10 to 15 turns.

* * * * *